US008770553B2

(12) United States Patent
Van Es

(10) Patent No.: US 8,770,553 B2
(45) Date of Patent: Jul. 8, 2014

(54) FENCE RAIL AND PICKET ASSEMBLY

(71) Applicant: Anton Van Es, Beamsville (CA)

(72) Inventor: Anton Van Es, Beamsville (CA)

( * ) Notice: Subject to any disclaimer, the term of this patent is extended or adjusted under 35 U.S.C. 154(b) by 0 days.

(21) Appl. No.: 13/935,509

(22) Filed: Jul. 4, 2013

(65) Prior Publication Data

US 2014/0021425 A1 Jan. 23, 2014

Related U.S. Application Data

(60) Provisional application No. 61/674,412, filed on Jul. 23, 2012.

(51) Int. Cl.
*E04H 17/00* (2006.01)

(52) U.S. Cl.
USPC ..... 256/65.08

(58) Field of Classification Search
USPC ..... 256/59, 65.01, 65.02, 65.03, 65.07, 256/65.08
See application file for complete search history.

(56) References Cited

U.S. PATENT DOCUMENTS

| | | | | | |
|---|---|---|---|---|---|
| 1,361,586 | A | * | 12/1920 | Johnson | 52/211 |
| 1,712,019 | A | * | 5/1929 | Baum | 52/215 |
| 2,218,894 | A | * | 10/1940 | Schlosser | 248/73 |
| 3,080,980 | A | * | 3/1963 | Gibbons | 248/222.52 |
| 3,636,672 | A | * | 1/1972 | Fink | 52/214 |
| 3,795,453 | A | * | 3/1974 | Condevaux | 403/3 |
| 3,902,703 | A | | 9/1975 | Bouye | |
| 4,156,515 | A | * | 5/1979 | Mochly | 248/246 |
| 4,274,614 | A | * | 6/1981 | Worrallo | 248/243 |
| 4,299,368 | A | * | 11/1981 | Winkler | 248/246 |
| 4,387,887 | A | * | 6/1983 | Gentry | 269/100 |
| 4,442,644 | A | * | 4/1984 | Jukes | 52/213 |
| 4,519,511 | A | * | 5/1985 | Mendenhall | 211/187 |
| 4,609,185 | A | | 9/1986 | Prater et al. | |
| 4,961,553 | A | * | 10/1990 | Todd | 248/62 |
| 5,154,385 | A | * | 10/1992 | Lindberg et al. | 248/225.11 |
| 5,265,740 | A | * | 11/1993 | Hodsden et al. | 211/187 |
| 5,318,264 | A | * | 6/1994 | Meiste | 248/222.12 |
| 5,669,198 | A | * | 9/1997 | Ruff | 52/656.4 |
| 5,695,174 | A | | 12/1997 | Tsai | |
| 6,199,336 | B1 | * | 3/2001 | Poliquin | 52/489.1 |
| 6,499,725 | B2 | * | 12/2002 | Meis et al. | 256/65.03 |
| 6,578,335 | B2 | * | 6/2003 | Poliquin | 52/481.2 |
| 6,591,996 | B1 | * | 7/2003 | Wu | 211/90.02 |
| 7,232,114 | B2 | | 6/2007 | Platt | |
| 8,297,575 | B2 | * | 10/2012 | Kluge | 248/244 |
| 2006/0197074 | A1 | | 9/2006 | Smith et al. | |

* cited by examiner

*Primary Examiner* — Michael P Ferguson
*Assistant Examiner* — Daniel Wiley

(57) ABSTRACT

A fence rail and picket assembly includes a retainer for joining a picket upright to a fence rail. The retainer includes a forward portion including locking heads and a tongue portion. A picket upright formed of sheet material including rear flanges and defining a retainer cavity for receiving the forward portion of the retainer therein. The picket upright includes apertures along rear flanges for receiving the retainer heads there through. A fence rail receives the tongue portion of the retainer there on for operably securing the tongue to the rail.

9 Claims, 6 Drawing Sheets

FIG. 2
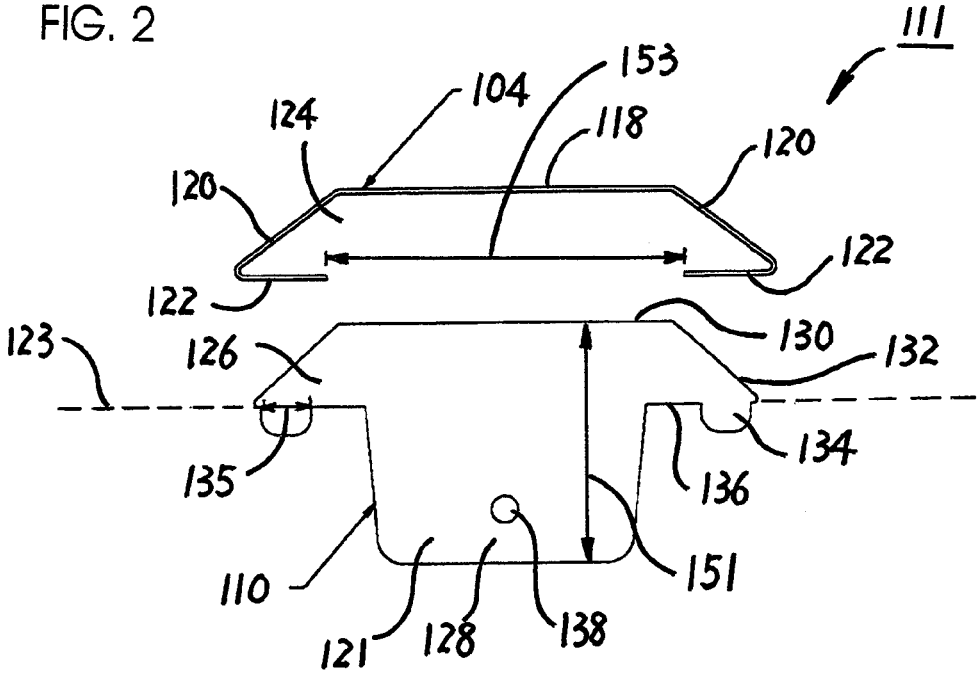
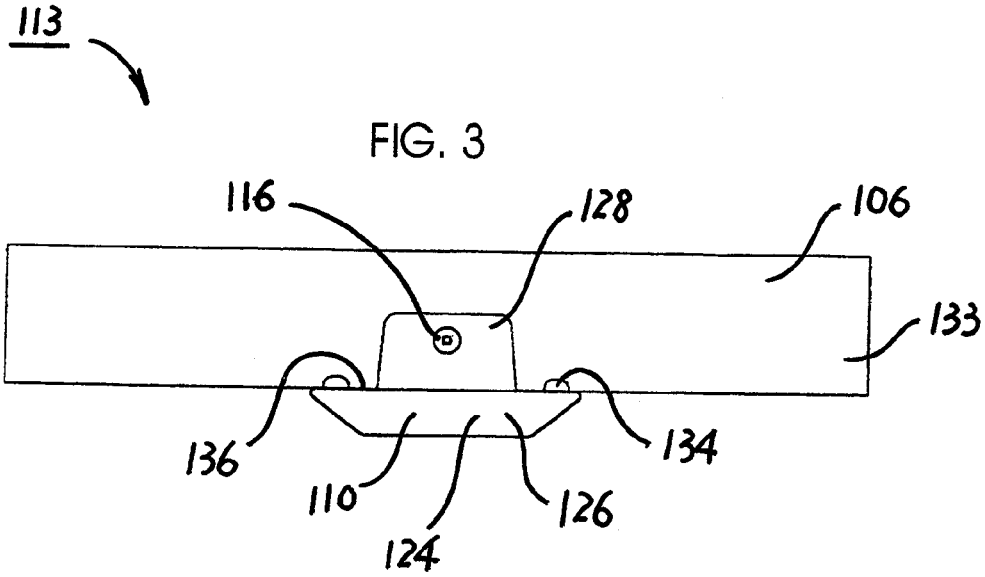
FIG. 3

FENCE RAIL AND PICKET ASSEMBLY

This application claims priority from previously filed U.S. provisional patent application No.: 61/674,412 filed Jul. 23, 2012 in the name of Anton Van Es under the title FENCE RAIL AND PICKET ASSEMBLY.

FIELD OF THE INVENTION

This invention relates to fences and more particularly pertains to construction methods for sheet metal fences and fence rail and picket assemblies.

SUMMARY OF THE INVENTION

A fence rail and picket assembly comprising:

a) a retainer for joining a picket upright to a fence rail;

b) the retainer includes a forward portion including locking heads and a tongue portion;

c) a picket upright formed of sheet material includes rear flanges and defining a retainer cavity for receiving the forward portion of the retainer therein;

d) the picket upright including apertures along rear flanges for receiving the retainer heads there through;

e) a fence rail receives the tongue portion of the retainer there on for operably securing the tongue to the rail.

Perferrably wherein the retainer further including a rear edge defining a retainer axis and the heads projecting from the rear edge, wherein the retainer is rotated about the retainer axis from a pre locked position to an installed position thereby urging the heads into the apertures.

Perferrably wherein the retainer dimensioned to fit into the retainer cavity when in an insertion position.

Perferrably wherein a retainer length is less than an upright width to accommodate insertion of the retainer into the retainer cavity.

Perferrably wherein the upright including a side walls extending outwardly from each side of a front wall, and rear flanges extending inwardly form each sidewall, such that in cross section the front wall, sidewalls and rear flanges define the opening of the retainer cavity.

Perferrably wherein the forward portion of the retainer is adapted to nest within the interior dimensions of the retainer cavity with the exception of the heads.

Perferrably wherein the tongue includes a retainer aperture for receiving a fastener there through for fastening the retainer to the rail.

Perferrably wherein the retainer heads are dimensioned to interferingly fit onto the apertures of the upright when the retainer is rotated about the retainer axis from a pre locked position to an installed position thereby interferingly urging the heads into the apertures.

BRIEF DESCRIPTION OF THE DRAWINGS

With the intention of providing demonstration of the characteristics of the device or method, an example is given below, without any restrictive character whatsoever, with reference to the corresponding figures, of a preferred embodiment of the device and method as follows;

FIG. 2 is a top plan view of an unassembled upright and a retainer.

FIG. 3 is a top schematic plan view of an assembled fence rail and picket assembly showing the upright being supported and retained by the retainer on the rails.

DESCRIPTION OF THE PREFERRED EMBODIMENTS

Figure 1:
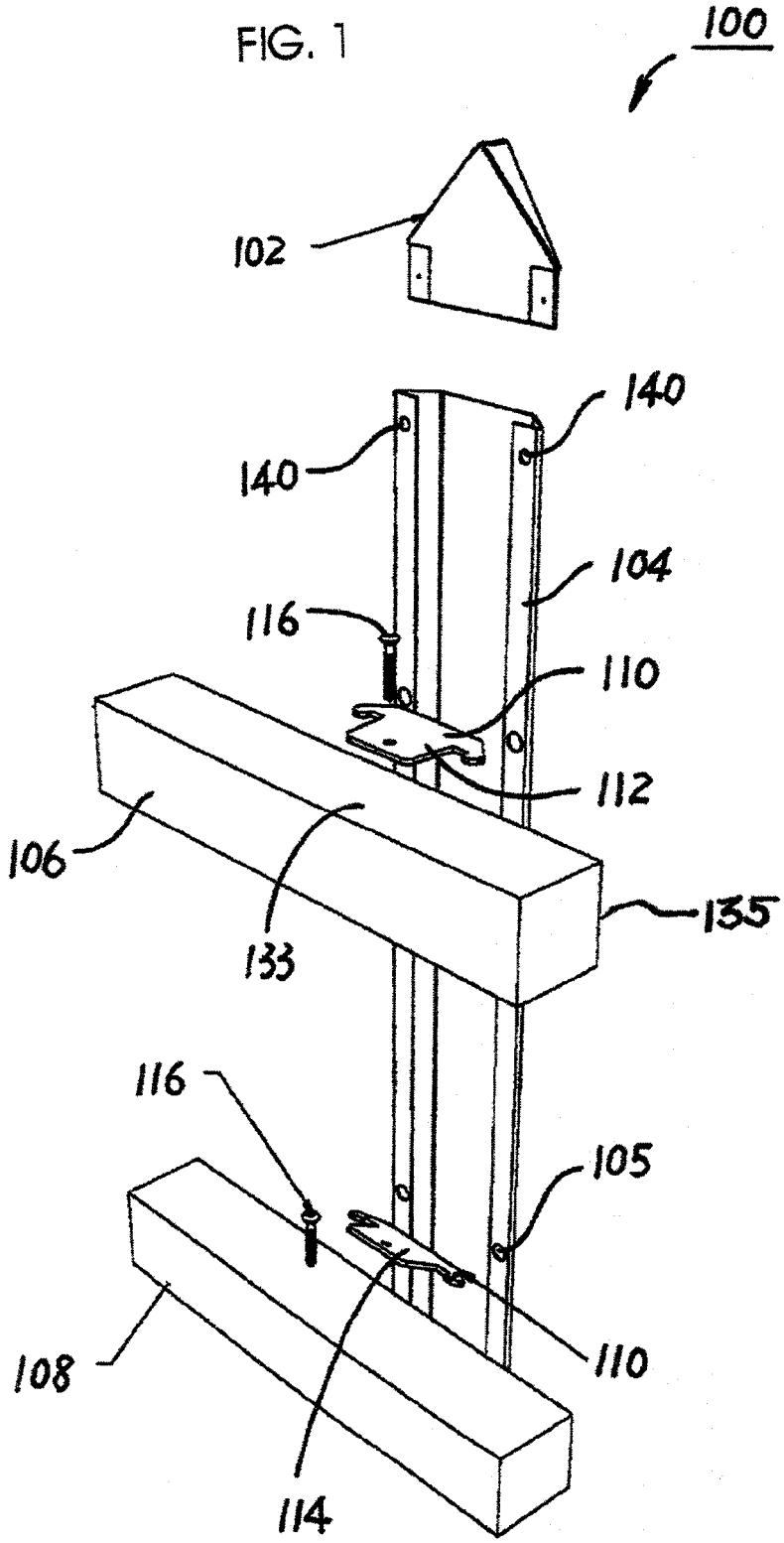
FIG. 1 is a schematic exploded perspective assembly view of the fence rail and picket assembly.
Figure 5:
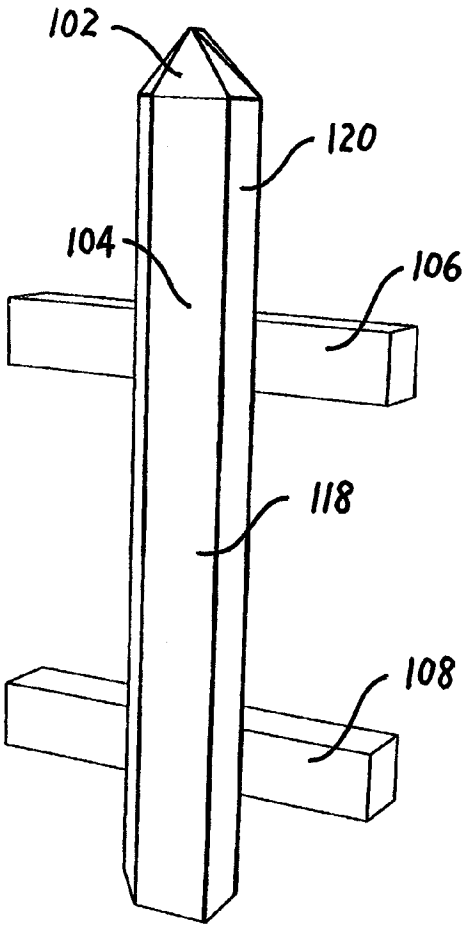
FIG. 5 is a front side schematic perspective view of an assembled fence rail and picket assembly.

The present concept the fence rail and picket assembly is shown generally as 100 and includes the following major components namely uprights 104 held in place with retainers 110 onto rails shown as upper rail 106 and lower rail 108 with fasteners 116.

Fence rail and picket assembly 100 includes an ornamental cap shown as 102 that is received into the top of upright 104 and is held in place by using fasteners through holes 140.

Upright 104 also includes apertures 105 which operate through lock retainer 110 onto upright 104 as will be later described.

Retainer 110 is shown in a horizontal position 112 and also is shown in a partially rotated position 114 and is fastened to upper and lower rails 106 and 108 using a fastener 116.

Referring now to FIG. 2 which shows in top plan view the cross section of upright 104 which includes a front wall 118, side walls 120, rear flanges 122 all of which define a retainer cavity 124.

Retainer 110 is shown in an uninstalled position 111 and includes a forward portion 126, a tongue portion 128, a front edge 130, a side edge 132 and a rear edge 136 which defines a retainer axis 123 and has projecting therefrom a head 134. Retainer 110 is preferably a plate 121 which is stamped out of sheet metal and includes a retainer aperture 138 for receiving fastener 116 there through.

The reader will note that the forward portion 126 of retainer 110 is adapted in dimension to be nested and received within retainer cavity 124 such that heads 134 project out of apertures 105 found within the rear flange 122 of the upright 104.

Referring now to FIG. 3 retainer 110 is shown in an installed position 113 wherein the forward portion 126 of retainer 110 is housed and received within retainer cavity 124 and heads 134 are projecting out of apertures 105 found in the rear flange 122 of upright 104. In the installed position 113, the front edge 130 of retainer 110 abuts against the front wall 118 of upright 104.

The tongue portion 128 of retainer 110 overlaps and makes contact with the top portion of upper rail 106 and is held in place with a fastener 116 which is received through retainer aperture 138 and fastened into the top portion 133 of upper rail 106. Upper and lower rail 106, 108 includes a vertical laterally extending side portion 135 which abuts with rear flanges 122 of upright 104.

Head 134 of retainer 110 has a head with W 135 which interferingly fits into the aperture 105 and makes contact at the outer edges thereof In this manner in the installed position 113 as shown in FIG. 3 the head 134 for retainers 110 holds the upright 104 in position onto the rails 106 and 108 as depicted.

Figure 4:
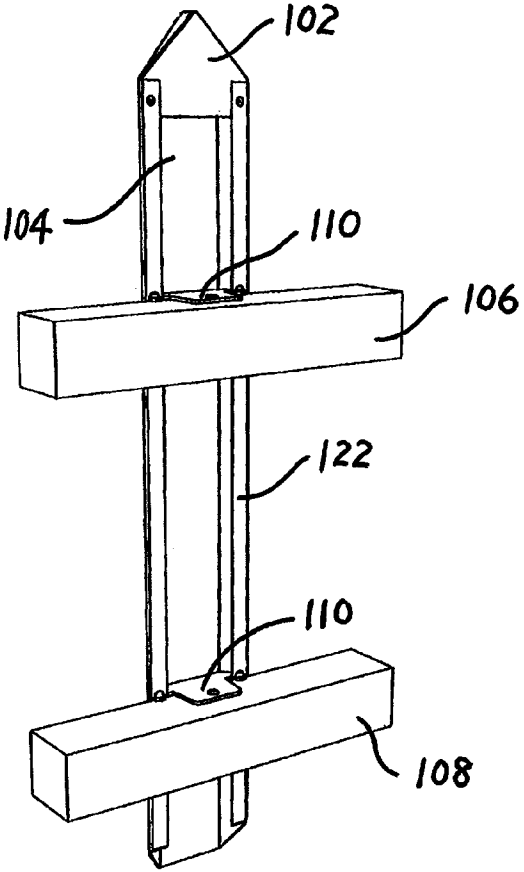
FIG. 4 is a back side schematic perspective view of an assembled fence rail and picket assembly.

Referring now to FIG. 4, depicted are 2 rails namely upper and lower rail 106 and 108 however there can be any number of rails holding the uprights 104 in position. In practice they are normally would be at least 1 retainer for each rail and the uprights 104 would have a multitude of apertures 105 thereby allowing for adjustability of the uprights 104 onto the upper rail 106 and lower rail 108 and/or additional rails if the uprights are particularly lengthy.

Figure 6:
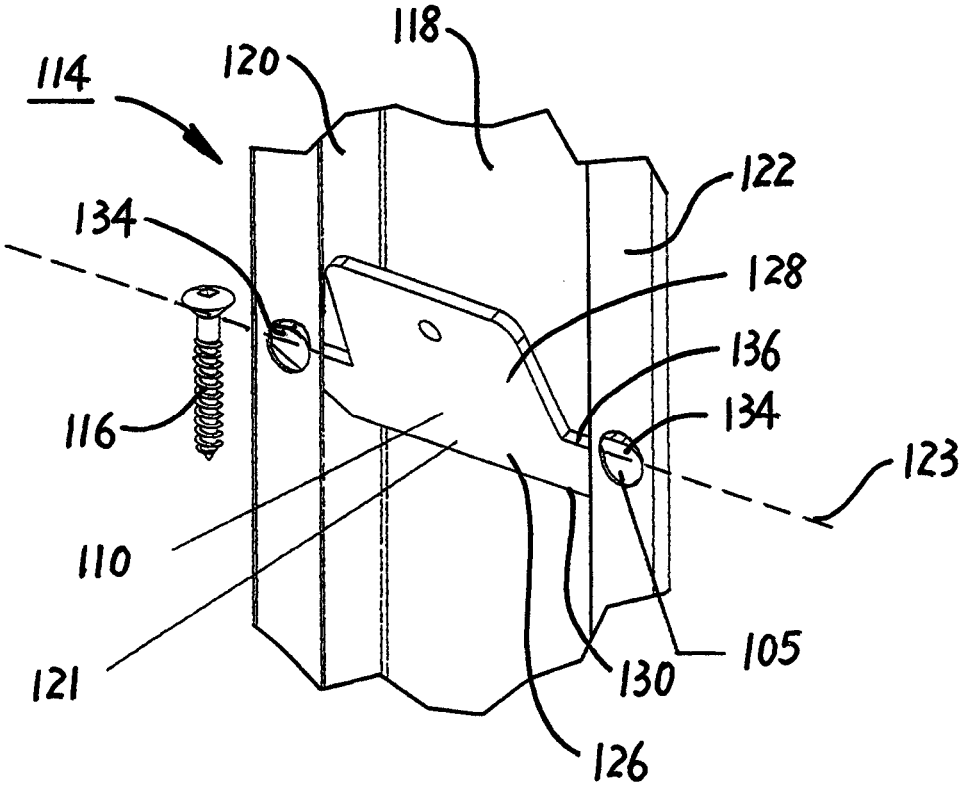
FIG. 6 is an enlarged back side schematic perspective view of the retainer being fitted into the upright.

Referring now to FIG. 6 retainer 110 is shown in a partially rotated position 114 wherein the heads 134 of retainer 110 project through apertures 105 in the rear flange portions 122 of upright 104.

Retainer 110 is rotated about retainer axis 123 which runs along rear edge 136 of retainer 110.

Figure 7:
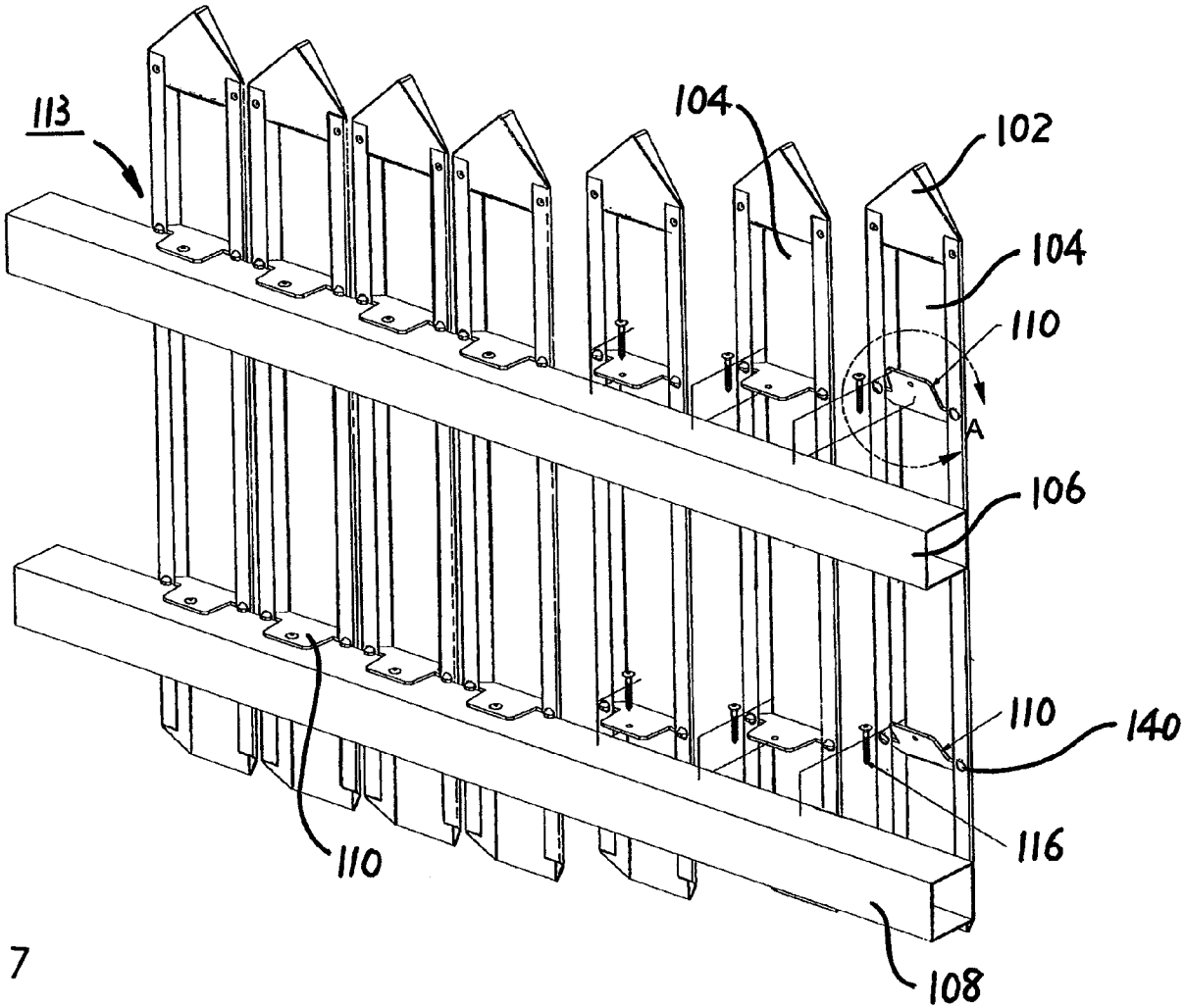
FIG. 7 is a back side schematic perspective view of a number of uprights being fitted onto the rails.
Figure 10:
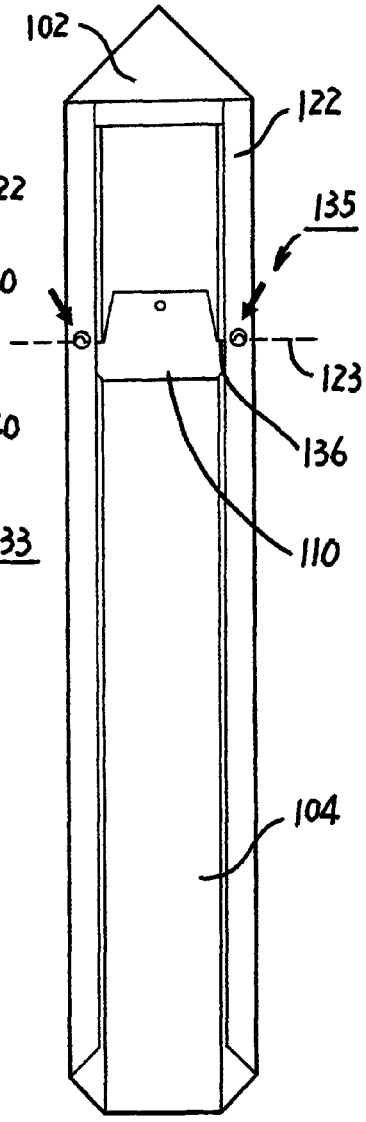
FIG. 10 is the same thing as FIG. 8 with the retainer in the pre-locked position.

Referring now to FIG. 7 the reader will note that retainer 110 is progressively rotated further about retainer axis 123 in order to manipulate it from the pre-locked position 135 shown in FIG. 10 to the installed position 113.

Figure 8:
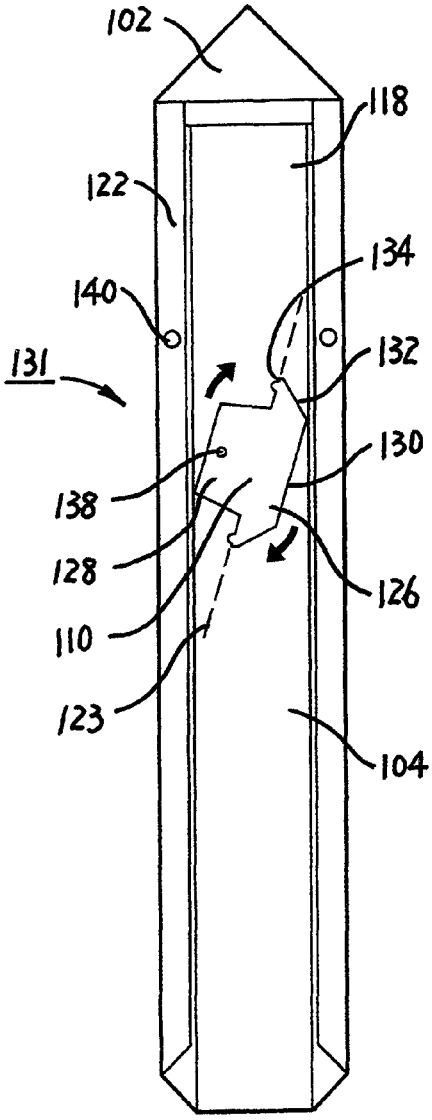
FIG. 8 is a schematic elevational back side view of a upright showing the retainer in the insertion position.
Figure 9:
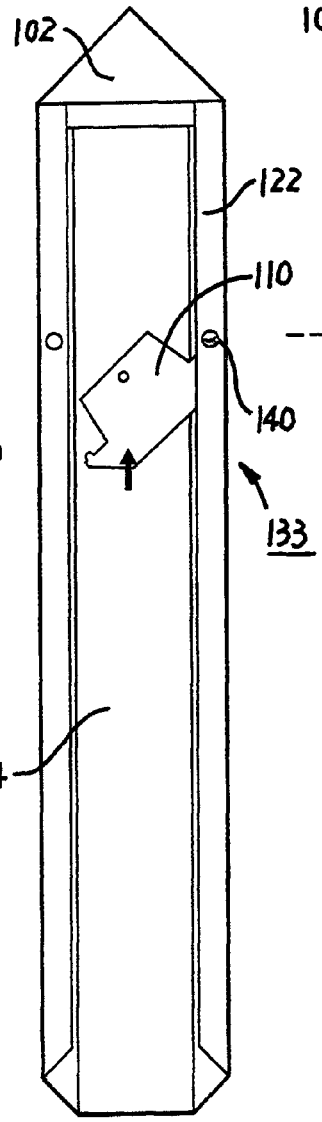
FIG. 9 is the same thing as FIG. 8 except showing the retainer in a partially tilted position.

Referring now to FIGS. 8, 9 and 10 which progressively show the manipulation of the retainer in order to manipulate it into the pre-locked position 135 for further rotation into the apertures 105.

Referring now to FIG. 8, retainer 110 is placed in a vertical orientation and rotated such that the retainer is in an insertion position 131 as shown in FIG. 8. In the insertion position the retainer axis 123 can in fact be totally vertically oriented or can be at a slight angle as shown in FIG. 8, provided that the retainer 110 is able to clear the rear flanges 122 of upright 104 thereby placing retainer 110 completely within retainer cavity 124. The retainer length 151 is less than the upright width 153 thereby facilitating passage of the retainer 110 into the retainer cavity 124.

Once the retainer 110 is within retainer cavity 124 it can be further tilted into a tilted position 133 as shown in FIG. 9.

Further rotating the retainer 110 until the retainer axis 123 is completely horizontal and the planer portion of the retainer itself is vertically oriented thereby putting it into the pre-locked position.

From this point on in order to manipulate the retainer 110 from the pre-locked position 135 to the installed position 113, one has to rotate the retainer 110 about retainer axis 123 which places the heads 134 into the apertures 105 of uprights 104 thereby locking the uprights 104 to the retainer 110 when the retainer 110 is in the installed position which is when the retainer is in a horizontal orientation with respect to its planer surface.

It should be apparent to persons skilled in the arts that various modifications and adaptation of this structure described above are possible without departure from the spirit of the invention the scope of which defined in the appended claim.

The invention claimed is:

1. A fence rail and picket assembly comprising:

a) a retainer for joining a picket upright to a fence rail;

b) the retainer includes a forward portion including a front edge, locking heads and a tongue portion;

c) a plurality of spaced apart and vertically oriented picket uprights formed of sheet material, each upright includes lateral rear flanges, a front wall and defines a retainer cavity for receiving the forward portion of the retainer therein;

d) the picket upright including apertures along the rear flanges for receiving the locking heads there through;

e) at least two spaced apart parallel and lateral extending fence rails oriented perpendicular to the picket uprights and extending horizontally across each of the picket uprights and abutting tin against the rear flanges of the picket uprights, the fence rails receives the tongue portion of the retainer there on for operably securing the tongue portion to the rail;

f) wherein in an installed position, the front edge of the retainer abuts against a front wall of the picket upright and the heads fit interferingly through the picket apertures;

g) wherein the retainer further includes a rear edge defining a retainer axis and the heads projecting from the rear edge, wherein the retainer is rotated about the retainer axis from a pre locked position to an installed position thereby urging the heads through the apertures thereby preventing any movement of the retainer except for rotation about the retainer axis and such that the rear edge abuts against the rear flange in the installed position;

h) wherein the locking heads are dimensioned to interferingly fit into the apertures of the upright when the retainer is rotated about the retainer axis from a pre locked position to an installed position thereby interferingly urging the heads through the apertures without deforming the locking heads such that the retainer can be subsequently removed without damage or deformation for subsequent reuse.

2. The fence rail and picket assembly claimed in claim 1, wherein the retainer is dimensioned to fit into the retainer cavity when in an insertion position.

3. The fence rail and picket assembly claimed in claim 2, wherein a retainer length is less than an upright width to accommodate insertion of the retainer into the retainer cavity.

4. The fence rail and picket assembly claimed in claim 3, wherein the upright includes side walls extending outwardly from each side of a front wall, and rear flanges extending inwardly form each sidewall, such that in cross section the front wall, sidewalls and rear flanges define the opening of the retainer cavity.

5. The fence rail and picket assembly claimed in claim 1, wherein the forward portion of the retainer is adapted to nest within the interior dimensions of the retainer cavity with the exception of the heads , such that the front edge abuts against the front wall and a rear edge abuts against the rear flange.

6. The fence rail and picket assembly claimed in claim 1, wherein the tongue includes a retainer aperture for receiving a fastener there through for fastening the retainer to the rail thereby preventing any movement of the retainer.

7. The fence rail and picket assembly claimed in claim 1, wherein the locking heads are semi-circular projections and the apertures are circular holes.

8. The fence rail and picket assembly claimed in claim 1, wherein the fence rail includes a horizontal laterally extending top portion for receiving the tongue portion in abutting relationship thereon.

9. The fence rail and picket assembly claimed in claim 8, wherein the fence rail includes a vertical laterally extending side portion in abutting relationship with the rear flanges of the picket upright.

* * * * *